US005597078A

United States Patent [19]

Becker et al.

[11] Patent Number: 5,597,078

[45] Date of Patent: Jan. 28, 1997

[54] MOBILE CRANE

[75] Inventors: Rudolf Becker, Ehingen; Hans-Dieter Willim, Unterweiler; Uwe Frommelt, Ehingen, all of Germany

[73] Assignee: Liebherr-Werk Ehingen GmbH, Ehingen/Donau, Germany

[21] Appl. No.: 286,746

[22] Filed: Aug. 5, 1994

[30] Foreign Application Priority Data

Aug. 6, 1993 [DE] Germany ..... 9311778 U

[51] Int. Cl.[6] ..... B66C 23/04

[52] U.S. Cl. ..... 212/231; 212/177; 212/299; 212/348

[58] Field of Search ..... 212/230, 231, 212/264, 295, 296, 297, 298, 299, 300, 348, 177

[56] References Cited

U.S. PATENT DOCUMENTS

| | | | |
|---|---|---|---|
| 3,831,771 | 8/1974 | Wiencek | 212/264 |
| 3,938,670 | 2/1976 | Wellman | 212/296 |
| 4,106,631 | 8/1978 | Lundy | 212/231 |
| 4,383,616 | 5/1983 | Sterner et al. | 212/296 |
| 4,394,914 | 7/1983 | Privat | 212/300 |
| 4,498,596 | 2/1985 | Haulotte | 212/231 |

FOREIGN PATENT DOCUMENTS

| | | | |
|---|---|---|---|
| 1200815 | 8/1970 | United Kingdom | 212/177 |
| 1251578 | 10/1971 | United Kingdom | 212/177 |
| 2041326 | 9/1980 | United Kingdom | 212/264 |

*Primary Examiner*—Thomas J. Brahan
*Attorney, Agent, or Firm*—Dilworth & Barrese

[57] ABSTRACT

The invention relates to a mobile crane comprising a lower vehicle and an upper vehicle turningly mounted thereon and bearing a telescoping boom with a luffing cylinder for the pivoting thereof. The telescoping boom comprises two parts able to be bolted together and each having an external tube, from which respectively at least one telescope member may be extended.

9 Claims, 4 Drawing Sheets

MOBILE CRANE

BACKGROUND OF THE INVENTION

The invention relates to a mobile crane comprising a lower vehicle and an upper vehicle turningly mounted thereon and bearing a telescoping boom with a luffing cylinder for the pivoting thereof.

Various different forms of such mobile cranes are in existence, there being the possibility of extending the telescoping boom by a latticed top member permanently connected with the upper end of the internal telescope member or however of pivotally providing the internal telescope member with a braced, luffing latticed top member.

One object of the invention is to design a mobile crane of the sort noted initially which while possessing enhanced possibilities of application, may readily be changed over between the condition for operation as crane and the state for transportation.

SUMMARY OF THE INVENTION

In accordance with the invention in order to achieve this and/or other objects appearing herein the telescoping boom comprises two parts able to be bolted together and each having an external tube, from which respectively at least one telescope member may be extended. In the case of the telescoping boom in accordance with the invention the external telescope tube of the upper part is adapted to be bolted to the upper end of the internal telescope section, which is able to be telescoped out from the lower telescope tube. Since the telescoping boom in accordance with the invention comprises two "telescopes", that is to say two portions, which are respectively able to be telescoped as such, it is consequently possible to perform a telescoping extension operation more or less steplessly from the lowest hook height to a maximum, if need be very substantial, hook height.

In the case of the telescope crane in accordance with the invention during transportation only the lower part, which is able to be telescopingly drawn out, remains on the truck whereas the upper part adapted to be telescopingly extended will be transported on a customized trailer. In this respect the two parts of the telescoping boom which are able to be telescopingly extended can be simply connected together by moving the crane truck into a suitable position in relation to the trailer, which transports the upper telescopably extending part and then, by suitably turning the upper vehicle and outward telescoping of the lower boom part, bringing the parts into an engagement position in which they are able to be bolted together.

If extremely heavy loads are to be lifted the mobile crane in accordance of the present invention can be employed with a short boom, which only comprises the lower part of the telescoping boom. In this manner of operation with a truncated boom the mobile crane in accordance with the invention can provide its own ballasting action. The ballast weight is transported by a separate vehicle and can be taken therefrom by the mobile crane of the invention with a foreshortened boom and deposited at the predetermined position on the lower vehicle part.

It is convenient if only one internal telescope section is able to be extended from the external telescope tube constituting the pivot connection member. From the upper external telescope tube, which is able to be connected with the internal telescope section of the lower part of the telescoping boom, at least two and preferably three telescope sections can be extended.

In accordance with a further advantageous development of the invention on the lower terminal part of the external telescope tube of the upper part of the telescoping boom a rear bracing jib is pivoted, which is held by means of a collapsible auxiliary strut leading to the upper external telescope tube and the end of the bracing jib is able to be braced by a lower brace in relation to the foot part of the lower external telescope tube and by a collapsing upper brace in relation to the head part of one of the telescopably extending upper telescope sections, preferably of the first telescopably extending telescope section. This bracing action furnishes the boom with a greater flexural rigidity so that it is suitable for raising heavier loads. In accordance with the invention the braces are so arranged that they render possible a simple and rapid erection and packing up of the telescoping boom. Should the upper telescopically extending part still be bolted to the lower telescopably extending part of the telescoping boom with a generally horizontal position of the sections still telescopically retracted, the first step will be to mount the lower brace of the bracing jib.

By outward telescoping of the internal telescope tube the bracing jib is erected in the operational position, in which it is held by means of the auxiliary brace.

The tensioning of the braces is thereafter automatic owing to outward telescoping of the sections or, respectively, of the section of the upper and lower parts of the telescoping boom. The aim of having compact and readily transported parts is then achieved by folding back both the bracing jib and also the upper brace against the inwardly telescoped upper part of the telescoping boom.

It is convenient for the braces to comprises rods.

An other advantageous feature of the invention is such that the upper brace pivoted on the head part of the first telescope section comprises two rods connected together in the middle part thereof. The parts of the rods then correspond to the length of the bracing jib and of the external telescope tube so that together with the bracing jib they are folded against the external telescope tube.

The lower brace is preferably able to be separated in its middle part. In the case of this form of the invention the lower part of the brace then remains on the crane vehicle during transportation, whereas the upper part of the lower brace is folded against the bracing jib.

BRIEF DESCRIPTION OF THE DRAWINGS

One embodiment of the invention will now be described with reference to the drawings in more detail.

DESCRIPTION OF THE PREFERRED EMBODIMENTS

Figure 1:
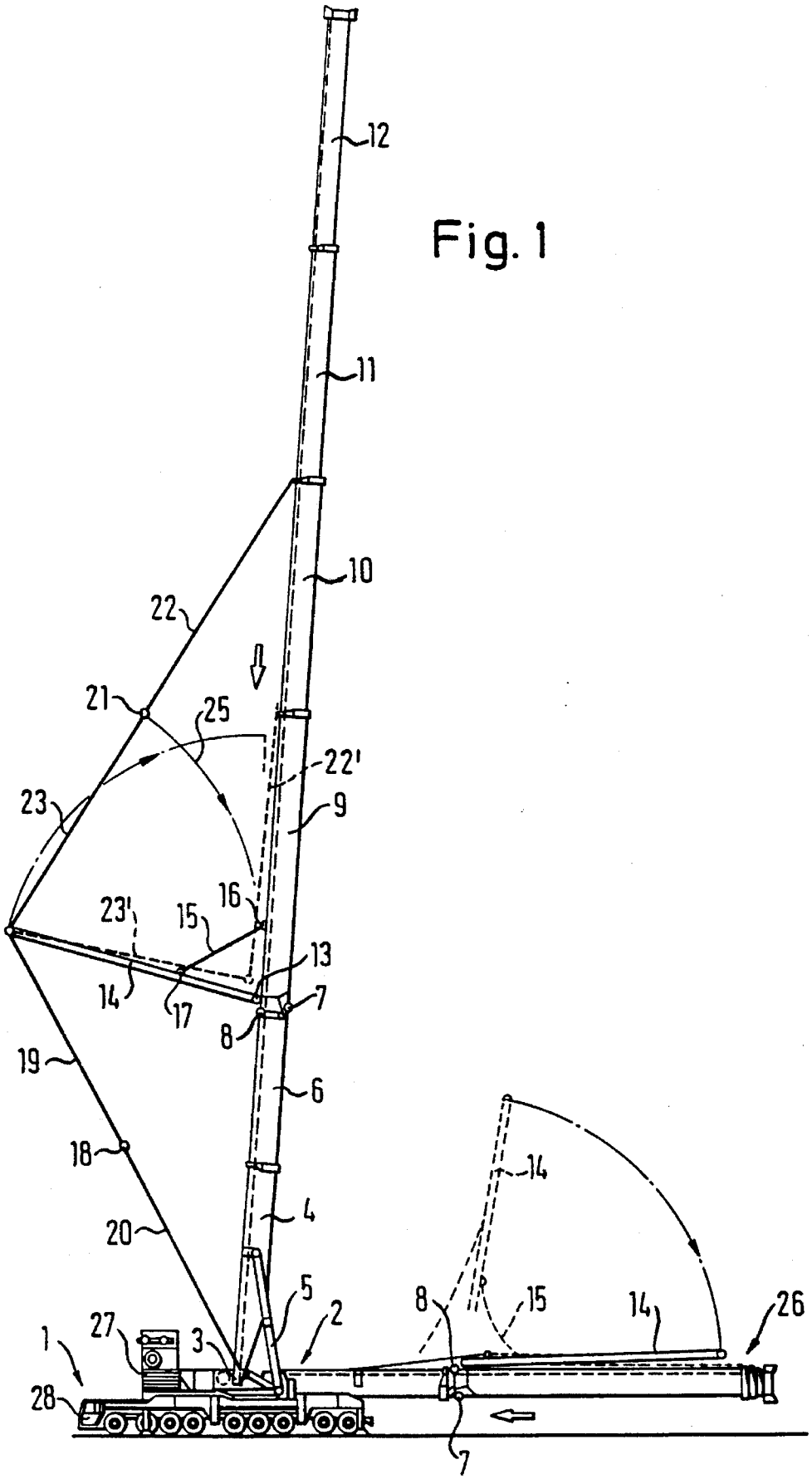
FIG. 1 is a lateral elevation of the mobile crane in accordance with the invention in the operational state thereof, the telescope sections of the two telescopically extending parts constituting the telescopic boom being completely extended.

The mobile crane according to the invention comprises a mobile crane truck 1 constituting the lower vehicle and on which the upper vehicle is rotatably mounted in a conventional fashion. On the upper vehicle the external telescope tube 4 of the lower part of the telescoping boom is pivoted about the axis 3. This external telescope tube is able to be luffed in a conventional fashion using two luffing cylinders 5. A telescope section 6 is able to be telescoped out from the external telescope tube of the lower part of the telescoping boom. The upper end of the telescopically extending section 6 is bolted to the upper external telescope tube 9 by bolt connections 7 and 8. The telescope sections 10, 11 and 12 are able to be telescoped out from the external telescope tube 9.

On the rear side of the foot part of the external upper telescope tube 9 the bracing jib 14 is pivotally connected by means of the bolt 13. The bracing jib 14 is braced in relation to the upper external telescope tube 9 by means of an auxiliary strut 15, whose pivot points 16 and 17 are located on the bracing jib 14 and on the external telescope tube 9 generally in the first third of the overall length of such parts, as measured from the pivotal connection 13. The bracing jib 14 is connected by means of the brace rods 19 and 20, which are connected together at the point 18 or joint, with the foot part of the lower, external telescope tube 4. The external end of the bracing jib 14 is furthermore connected by means of the brace rods 22 and 23, which are connected by the joint 21, with the upper terminal or end part of the first section 10, which is able to be telescoped out from the telescope tube 9.

The brace rods 19 and 20 of the lower brace may additionally be provided with setting screw threads of opposite hand and associated tightening nuts.

In order to move the mobile crane as shown in FIG. 1 out from the operational setting into the transportation setting, the telescope elements 12, 11 and 10 are inwardly telescoped into the external telescope tube 9 of the upper boom part and in the course of such inward telescoping movement the brace rods 22 and 23 will pivot about the joint 21 in such a manner that they will assume, after inward telescoping motion, the position 22 and 23 as shown in broken lines. The articulating connection 21 then moves in the direction marked by the circularly arcuate arrow 25.

Once the upper telescopingly extending part has been completely telescoped inward to the full amount, then the luffable or dericking boom is pivoted, using the luffing cylinder 5, into the generally horizontal position 26. In such position the bracing jib 14 is folded in the fashion indicated onto the external telescope tube 9, the brace rods 22 and 23 being suitably folded too. The auxiliary strut 15 is also folded up in the manner indicated in FIG. 1. The lower braces 19 and 20 are separated from one another by undoing the connection 18, the upper brace rod 19 also being folded up against the upper brace jib 14 for the purpose of transportation. The lower brace rod 20 comes to lie against external, lower telescope tube 4. In the horizontal setting indicated in FIG. 1 of the parts, which are able to be telescoped inward, of the telescoping boom the bolted connections 7 and 8 are then undone so that the upper part, which is able to be telescoped outward, with the parts folded against the same may be separately transported away. Then after the lifting of the ballast weight 27 the lower part of the telescoping boom, which has been telescoped inward, is pivoted into position from the crane driver's cab 28 and locked in the transportation position thereof.

The assembly and erection of the mobile crane to assume its operational position takes place by performing the steps in the reverse order.

Figure 2:
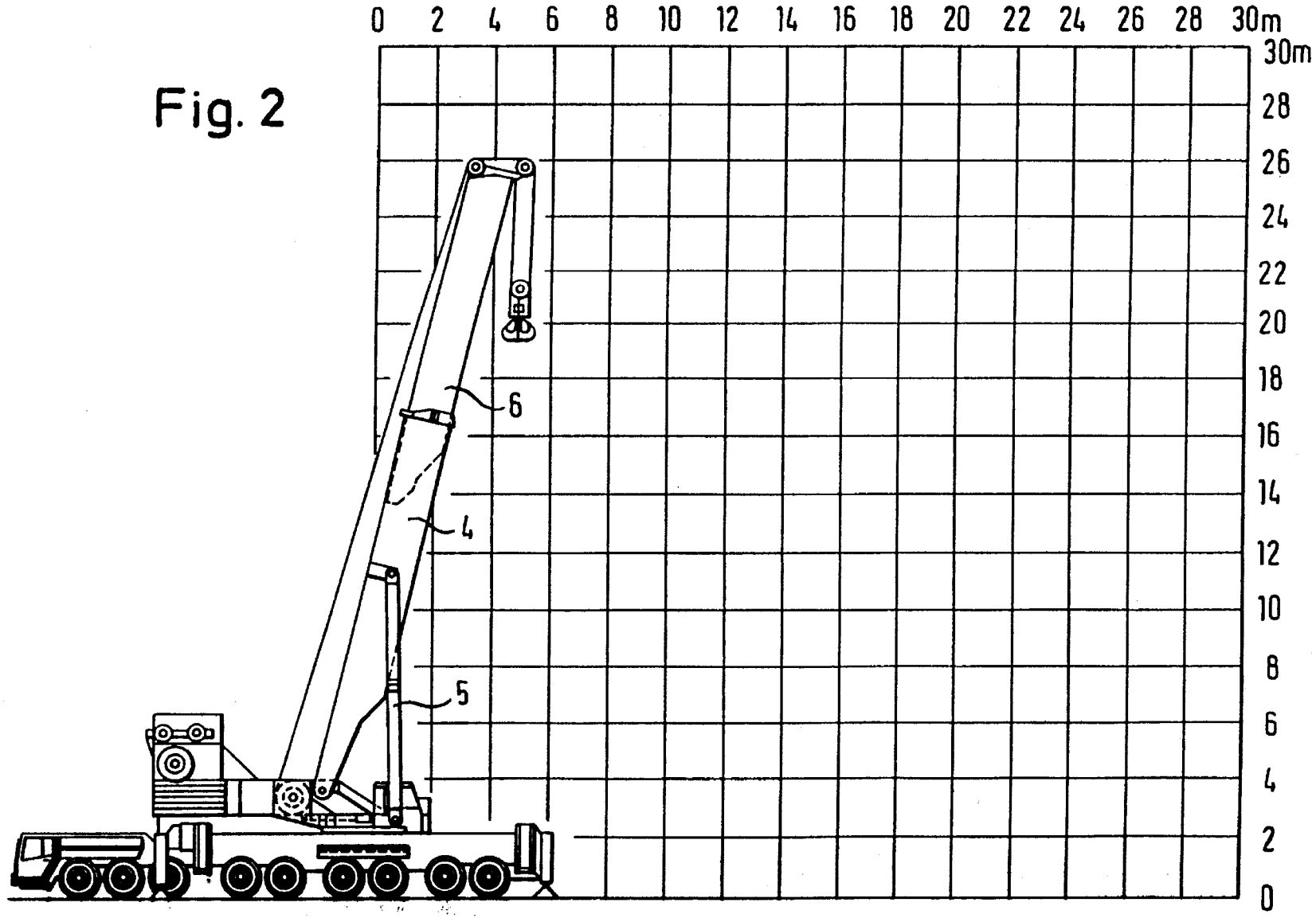
FIG. 2 is a lateral elevation, corresponding to FIG. 1, of the mobile crane in the operational state, in which the boom only consists of the lower telescopically extending part.

FIG. 2 is a lateral elevation of the mobile crane, in the case of which the boom merely consists of the lower boom part, that is to say the lower external telescope tube 4, from which the telescope section 6 has been telescopingly withdrawn.

Figure 3:
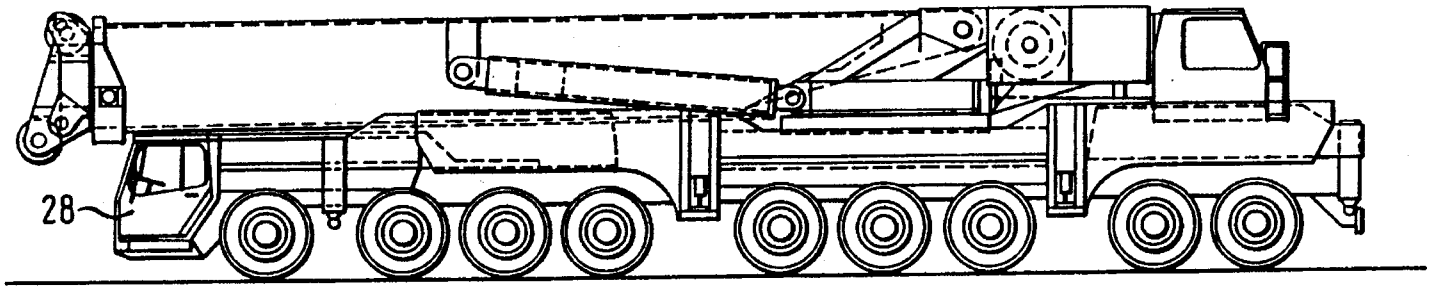
FIG. 3 is a side view of the mobile crane vehicle in the condition ready for transportation.

FIG. 3 shows a side elevation of the mobile crane vehicle in the transportation position, in which the telescopically retracted lower part of the telescoping boom is pivoted over the driver's cab 28 and locked in such transportation position.

Figure 4:
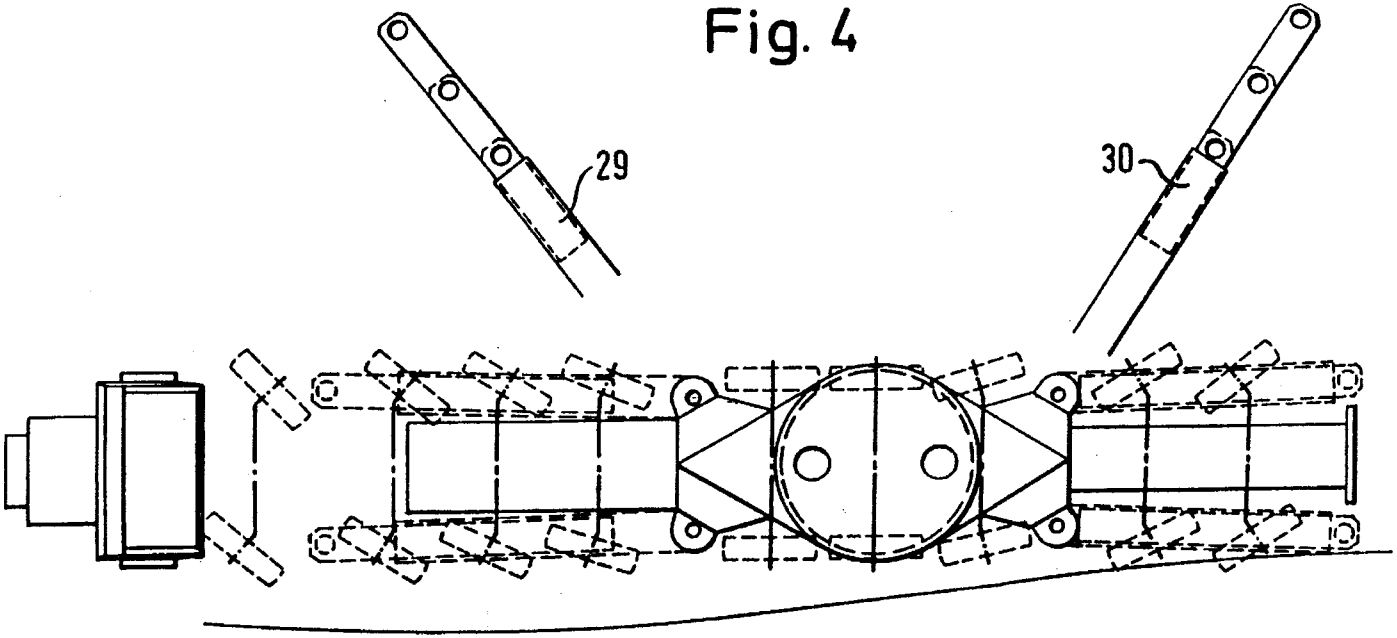
FIG. 4 is plan view of the mobile crane vehicle according to FIG. 3.

In FIG. 4 the reader will see the seven axles of the nine axled mobile crane vehicle. Inside the operational position the telescoping legs 29 and 30 are extended in the manner indicated.

Figure 5:
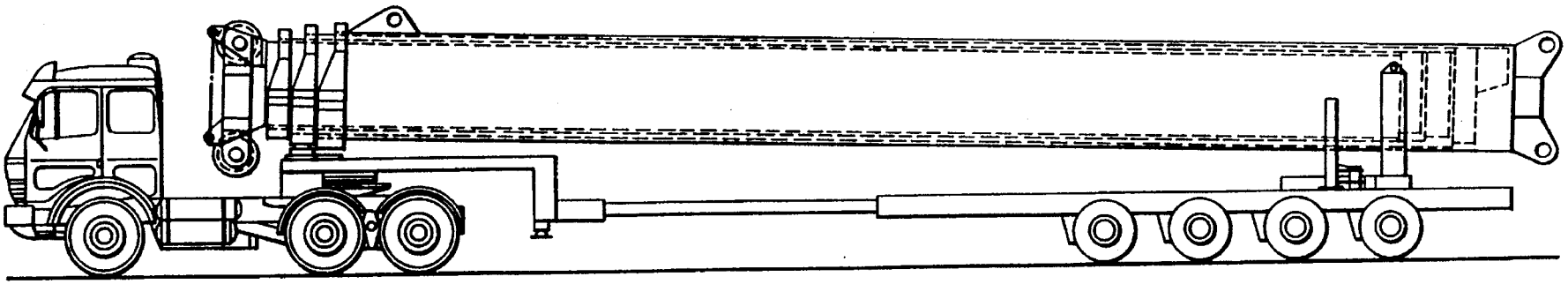
FIG. 5 is a lateral elevation of a semi-trailer truck for the upper telescopically extending part of the telescoping boom.

FIG. 5 is a lateral view of a semi-trailer truck, on which the inwardly telescoped upper part of the telescoping boom is held. In order to bolt this upper part of the telescoping boom with the upper end of the internal section 6 of the lower part the telescope parts are moved together, an accurate alignment of the joints to be bolted being possible by pivoting and outward telescoping of the lower telescope part.

We claim:

1. A mobile crane comprising:

a platform rotatably mounted on a vehicle; and a lower telescopic boom and an upper telescopic boom; wherein at least one telescopic section is structured and arranged to be extended out of each of said upper and lower telescopic booms;

said lower telescopic boom being pivotably connected to said platform and supported by a luffing cylinder for performing tilting movement thereof; and said lower telescopic boom and said upper telescopic boom are structured and arranged to be removably bolted together in a non-pivotal manner, such that said mobile crane can be operated both with and without said upper telescopic boom and said upper telescopic boom can be transported separately from said vehicle; and further comprising a rear bracing jib being pivoted upon a lower terminal part of said upper telescopic boom, a collapsible auxiliary strut coupling said rear bracing jib and said upper telescopic boom to retain said rear bracing jib, a lower brace coupling said rear bracing jib and a foot portion of said lower external telescopic boom to brace said rear bracing jib, and an upper brace arranged to couple said rear bracing jib with a head portion of said at least one telescopic section extending out of said upper telescopic boom, wherein said upper brace being arranged to be collapsible, and said lower brace is structured and arranged to be separated at a middle portion of said lower brace.

2. The mobile crane as claimed in claim 1, wherein only one internal telescopic section is structured and arranged to be telescoped out from said lower telescopic boom which additionally constitutes a pivotable attachment member.

3. The mobile crane as claimed in claim 2, wherein at least two telescopic sections are structured and arranged to be telescopically extended out from said upper telescopic boom.

4. The mobile crane as claimed in claim 3, wherein at least three telescopic sections are structured and arranged to be telescopically extended out from said upper telescopic boom, and said upper telescopic boom is structured and arranged to be connectable with said internal telescopic section of said lower telescopic boom.

5. The mobile crane as claimed in claim 1, wherein at least two telescopic sections are structured and arranged to be telescopically extended out from said upper telescopic boom.

6. The mobile crane as claimed in claim 5, wherein at least three telescopic sections are structured and arranged to be telescopically extended out from said upper telescopic boom.

7. The mobile crane as claimed in claim 1 additionally comprising at least two telescopic sections structured and arranged to be telescopically extended out from said upper telescopic boom, and wherein said upper brace is coupled to a head portion of a first telescopic section extending out from said upper telescopic boom.

8. The mobile crane as claimed in claim 7, wherein said upper brace is structured and arranged to be pivotably connected to the head portion of said first telescopic section and comprises two rods articulatingly coupled together at a middle portion of said upper brace.

9. The mobile crane as claimed in claim 1, wherein said upper and lower braces include bracing rods.

* * * * *